US008403420B2

(12) United States Patent
Billescas

(10) Patent No.: US 8,403,420 B2
(45) Date of Patent: Mar. 26, 2013

(54) REVERSIBLE FOOTREST

(76) Inventor: Ramon Billescas, McAllen, TX (US)

( * ) Notice: Subject to any disclaimer, the term of this patent is extended or adjusted under 35 U.S.C. 154(b) by 258 days.

(21) Appl. No.: 12/558,635

(22) Filed: Sep. 14, 2009

(65) Prior Publication Data

US 2011/0062740 A1 Mar. 17, 2011

(51) Int. Cl.
*A47C 20/00* (2006.01)

(52) U.S. Cl. ..... 297/423.19; 297/423.26; 297/423.37; 297/423.35; 297/423.4; 280/250.1

(58) Field of Classification Search ..... 297/423.19, 297/423.26, 423.29, 423.34, 423.35, 423.36, 297/423.4, 423.37; 280/250.1
See application file for complete search history.

(56) References Cited

U.S. PATENT DOCUMENTS

| | | | |
|---|---|---|---|
| 2,485,016 | A | 10/1949 | Rideout |
| 3,072,437 | A | 1/1963 | Shea et al. |
| 3,990,744 | A | 11/1976 | Rodaway |
| 4,164,354 | A | 8/1979 | Rodaway |
| 4,227,742 | A | 10/1980 | Thomas |
| 4,333,681 | A | 6/1982 | Nelson |
| 4,400,129 | A | 8/1983 | Eisenberg et al. |
| 4,486,048 | A | 12/1984 | Meyer |
| 4,538,857 | A | 9/1985 | Engman |
| 4,722,572 | A | 2/1988 | Sata |
| 4,770,467 | A | 9/1988 | Zinn |
| 4,790,553 | A | 12/1988 | Okamoto |
| 4,966,379 | A | 10/1990 | Mulholland |
| 4,968,051 | A | 11/1990 | Luo |
| 5,033,793 | A | 7/1991 | Quintile |
| 5,209,509 | A | 5/1993 | Gay et al. |
| 5,259,664 | A | 11/1993 | Cottle |
| 5,328,242 | A | 7/1994 | Steffens et al. |
| 5,328,247 | A | 7/1994 | Lovins |
| 5,393,082 | A | 2/1995 | Fenley |
| 5,401,045 | A | 3/1995 | Foerster et al. |
| 5,609,348 | A | 3/1997 | Galumbeck |
| 5,711,580 | A | 1/1998 | Barclay et al. |
| 5,713,591 | A | 2/1998 | Zarkhin et al. |
| D395,263 | S | 6/1998 | Ponce |
| 5,961,387 | A | 10/1999 | Parsons |
| 6,155,586 | A | 12/2000 | Melgarejo et al. |
| 6,168,238 | B1 | 1/2001 | Hannagan |
| 6,217,050 | B1 | 4/2001 | Dickie et al. |
| 6,273,443 | B1 | 8/2001 | Fleigle |
| 6,405,816 | B1 | 6/2002 | Kamen et al. |
| 6,422,653 | B1 | 7/2002 | Szczpanski et al. |
| 6,450,518 | B1 | 9/2002 | Howard |
| 6,450,581 | B1 | 9/2002 | Koerlin |
| 6,494,475 | B2 | 12/2002 | Rossi et al. |
| 6,499,756 | B2 | 12/2002 | Amirola |
| 6,533,360 | B1 | 3/2003 | Parkel |
| 6,585,279 | B1 | 7/2003 | Galloway et al. |
| 6,634,665 | B2 | 10/2003 | Hargroder |
| 6,773,073 | B1 | 8/2004 | Escobedo |
| 6,880,845 | B1 | 4/2005 | Broyles et al. |
| 6,932,369 | B2 | 8/2005 | Walsh et al. |
| 6,966,569 | B2 | 11/2005 | Miyoshi |
| 6,981,714 | B1 | 1/2006 | Schell et al. |
| 7,121,577 | B2 | 10/2006 | Schenck et al. |

(Continued)

*Primary Examiner* — Laurie Cranmer

(57) ABSTRACT

A reversible footrest includes an upper mounting device having attachment mechanisms mountable to either side of a wheelchair. An upper mounting device is connected to the lower mounting device which has a first support member that is capable of supporting a foot of a wheelchair user. A second mounting device having a support rod and supporting mechanism may be used to allow the reversible footrest to be raised or lowered. A second support member may also be used to support the lower leg of the wheelchair user. The attachment mechanisms and leg supporting components of the footrest are capable of being reversed to allow use on either side of the wheelchair.

25 Claims, 6 Drawing Sheets

U.S. PATENT DOCUMENTS 7,128,332 B2 10/2006 Hermes et al.
7,182,166 B2 2/2007 Gray et al.
7,222,921 B2 5/2007 Farnella et al.
7,243,938 B2 7/2007 Stamps et al.
7,331,632 B2 2/2008 Wendt
7,347,497 B2 3/2008 Fujihara et al.
7,360,840 B2 4/2008 Barlow et al.
7,360,841 B2 4/2008 Barlow et al.
7,367,578 B2 5/2008 Jansen
7,374,195 B1 5/2008 Varner et al.
7,384,058 B2 6/2008 Munsey et al.

REVERSIBLE FOOTREST

BACKGROUND OF THE INVENTION

A footrest is a device that is used in conjunction with a wheelchair to support the legs and feet of a patient while sitting in the wheelchair. The footrest is necessary for comfort, facilitating good body positioning, and for patients who have pain or swelling in the lower extremities.

Known footrests have a common problem mainly encountered in nursing homes, inpatient rehabilitation facilities, hospitals, and other such facilities. The problem occurs when one wheelchair is used for transporting the patient for bathing or other task. Then, the wheelchair is used for transporting the patient to another area. Typically, the footrests for the wheelchair are not transported with the wheelchair and subsequently become lost. Later, it becomes difficult to locate footrests for the wheelchair. As many workers in the health care field have encountered, there may be numerous footrests that fit only one side of the wheelchair and none that fit the other side causing the workers to waste time looking for matching footrests for the wheelchair.

This results in lost productivity, frustration by performing an unnecessary repetitive task, and decreased patient care. The lost productivity occurs when a worker spends less time assisting the patient with daily tasks such as bathing, dressing, or other activity. The time that is wasted looking for matching footrests may be for a patient that is going to a doctor's appointment, on an outing with family or other destination. In many cases, if a patient is in a situation where they are not leaving a facility, such as to an appointment, in the interest of time, a worker may not place footrests on the wheelchair. This may result in discomfort and pain in the lower extremities and increased swelling for the patient. Some nursing home residents cannot speak or have dementia and cannot advise the worker of any pain that they may be experiencing.

More importantly, injury can occur if the patient's foot gets caught under a wheel and, if the worker continues to push the wheelchair, the patient can fall out of the chair causing an even greater injury. Some patients are not able to stand on their own and may fall attempting toiletry activities. This may be prevented if the workers have more time to attend to patient care. In instances such as these, an amount of time spent looking for footrests can be better spent on patient tasks. The amount of time that is lost can be significant when aggregated for each worker.

Known footrests are not attachable to both sides of a wheelchair because a connection plate is located on a bottom of a tubular portion of an attachment mechanisms. Thus, if the footrest were to be reversed, the connection plate would be on top and would not be able to be attached on the opposite side of the wheelchair. These and other disadvantages of current footrests exist.

SUMMARY OF INVENTION

The invention relates to a reversible footrest and reversible elevating footrest. The footrests include an attachment mechanism that allows the footrests to connect to two attachment pins that are typically present on most wheelchairs. The attachment mechanisms are preferably spaced a predetermined distance from each other to match the attachment pins of the wheelchair. A latch mechanism is present to secure the footrest to the wheelchair and prevent the footrest from being dislodged when the patient's foot is in place. A handle is connected to the latch mechanism facilitating removal of the footrest from the wheelchair and allowing placement on either side of the wheelchair. The attachment mechanism may include a detent pin that allows the footrest to be reversible and placed on either side of the wheelchair.

A calf support may be present on the footrest to support the lower leg of the patient sitting in the wheelchair to facilitate safety and comfort. The calf support also may be reversible by use of a detent pin that facilitates use of calf support on either side of wheelchair. A lower portion of the footrest may include a tubular member that is held in place by a detent pin enabling the footrest to be locked in place in a plurality of positions to accommodate a length of a patient's lower extremities. A footplate may also be used to support a foot of the patient. The footplate may also include a detent pin that enables the footplate to be reversible and usable on either side of the wheelchair.

The reversible elevating footrest includes a height adjustment mechanism that connects to first and second members of the footrest by use of a rod. The first and second members of the footrest may pivot on each other allowing the footrest to adjust its height to best accommodate the patient. The height adjustment mechanism and its components facilitate raising and lowering of the footrest. The device may also lock the footrest at a desired height to best accommodate the patient.

DETAILED DESCRIPTION OF THE INVENTION

Figure 1:
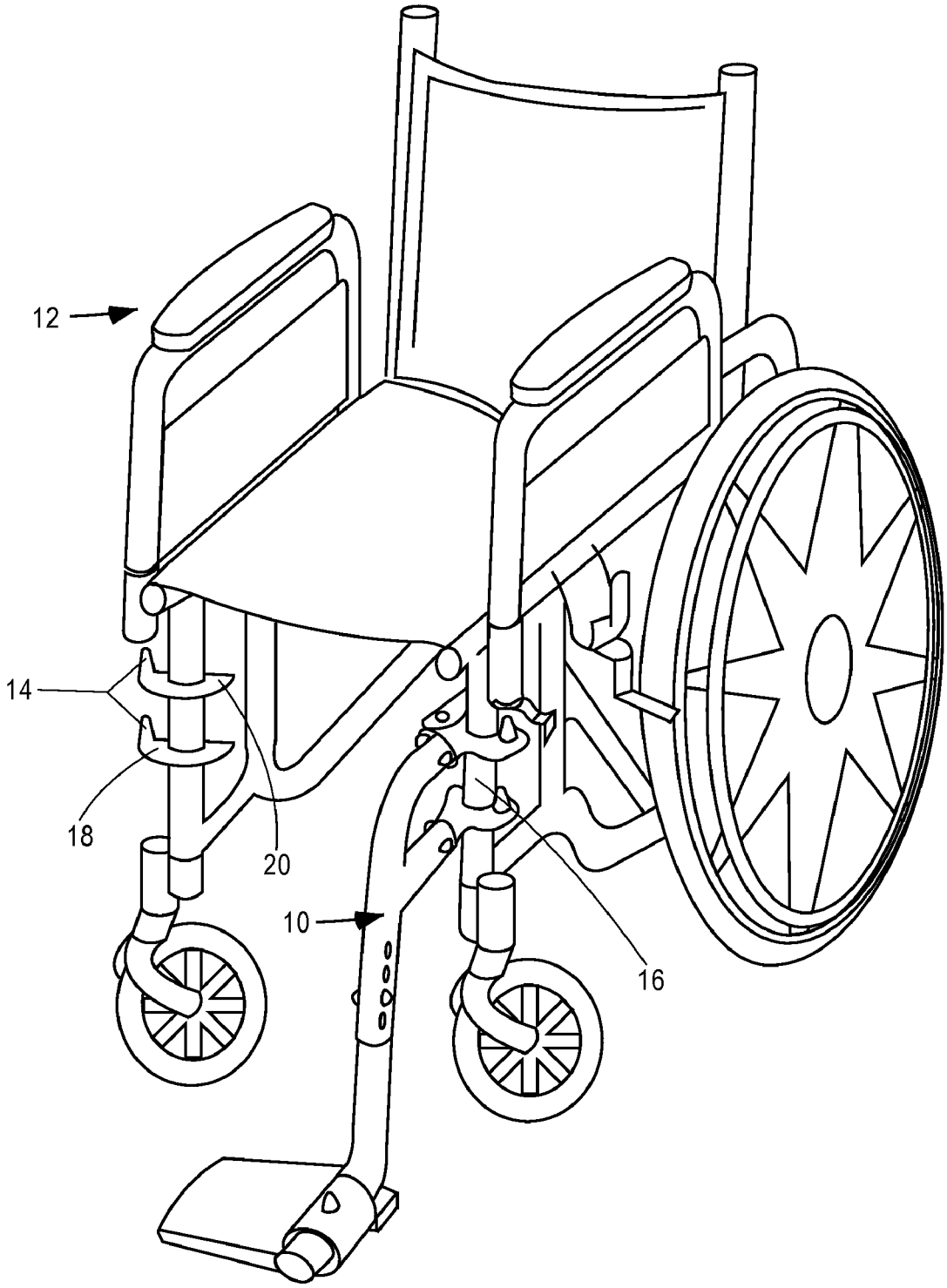
FIG. 1 illustrates a wheelchair having a reversible footrest according to one embodiment of the invention.

FIG. 1 illustrates a reversible footrest 10 provided on a typical wheelchair 12 according to one embodiment of the invention. The footrest 10 preferably attaches to a standard set of pins 14 provided on the wheelchair 12. The pins 14 are typically provided at a distance of either 1⅜" or 3¼" from each other, although other pin distances and attachment devices may be used. The set of pins 14 are located on one or both sides of the wheelchair 12 and supported by a tubular frame member 16, also on both sides of the wheelchair 12. A hinge plate 18 supports the footrest 10 when attached to the wheelchair 12. A notch 20 on the inside corner of the hinge plate 18 facilitates attachment of the footrest 10 to the wheelchair 12.

Figure 2:
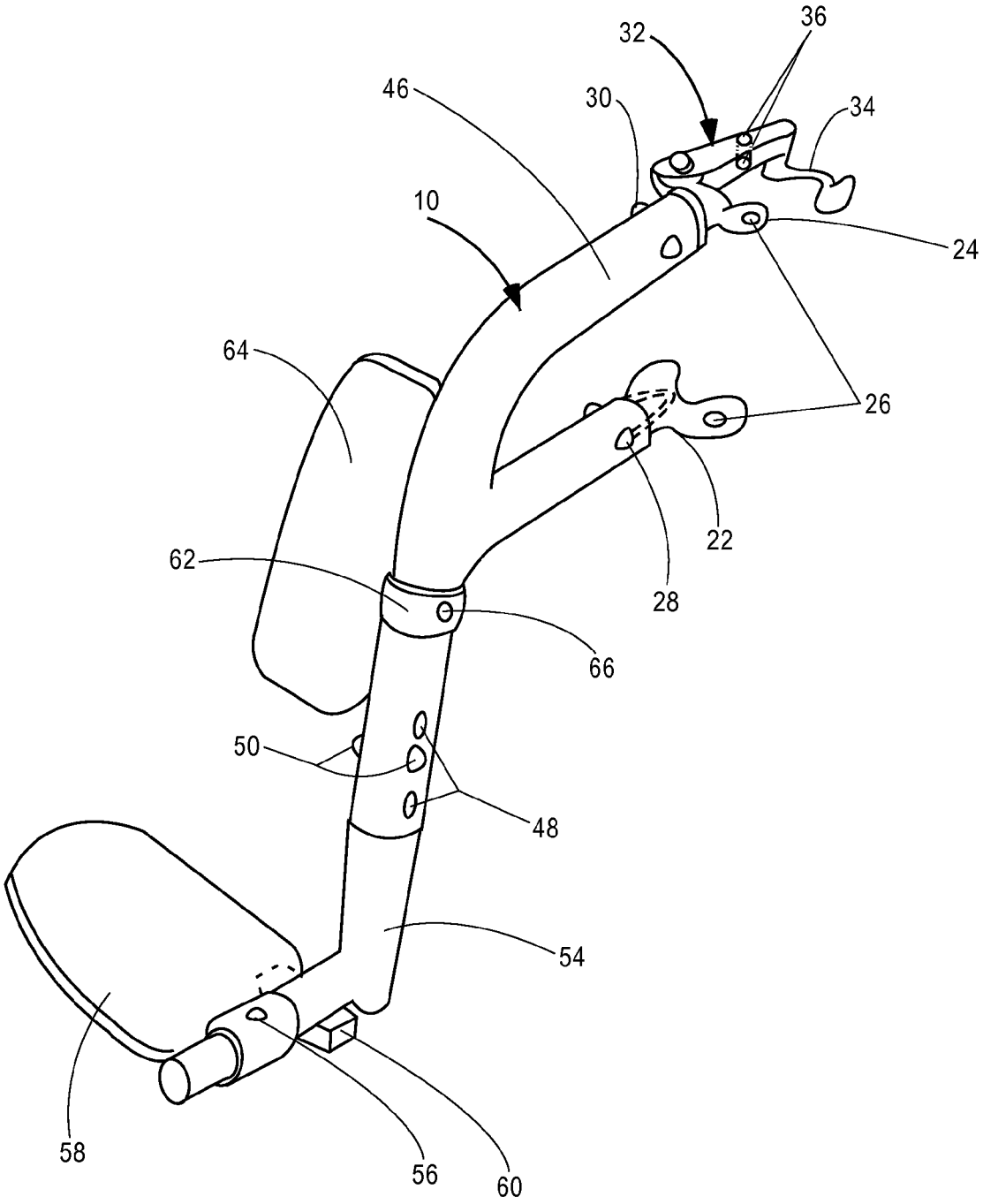
FIG. 2 illustrates a reversible footrest according to one embodiment of the invention.

FIG. 2 illustrates first and second attachment mechanisms 22, 24 with a set of corresponding pivot holes 26 enabling connection to the wheelchair 12. The pins 14 insert into the pivot holes 26 thus securing and supporting the footrest 10, in conjunction with the hinge plate 18. A latch mechanism 32 facilitates securing of the footrest 10 when an attachment bar 36 slides over the notch 20, locking the footrest 10 into place, as shown in FIG. 1.

A handle 34, located at the end of the latch mechanism 32, releases the attachment bar 36 from the notch 20, unlocking the footrest 10 from the wheelchair 12. In this embodiment a set of two detent pins 28, 30 in the first and second attachment mechanisms 22, 24 may be used to release the attachment mechanisms 22, 24. Other alternatives to the detent pins 28, 30, however, may be used such as, for example, a clamp and screw type locking system, twist and lock type mechanisms, screw end mechanisms, and snap-in-place type mechanisms. According to one embodiment, the footrest 10 is constructed from rigid thin walled hollow tubing and interconnected by welding. Typically, the tubing may include steel although materials such as plastic or other suitable materials may suffice.

Shown in FIG. 2, the first and second attachment mechanisms 22, 24 are connected to an upper mounting device 46. The upper mounting device 46 may be a tubular member having a plurality of holes 48 in its lower portion that serve as connection points to adjust a length of a lower mounting device 54. A detent pin 50 may be used to lock the lower mounting device 54 in place. Alternatives to the detent pin 50 may include, for example, a clamp and screw system.

Also illustrated in FIG. 2 is a first support member 58 located at the bottom of the lower mounting device 54 that supports the feet of the user. A stop mechanism 60, which may be, for example, a metal bar, keeps the first support member 58 from rotating beyond a point where it will cease to be in a desired position. A detent pin 56 locks the first support member 58 in place, though the stop mechanism 60 provides further support to the footrest 10. The first support member 58 may be identical on top and bottom and functions whether being used on the left or right side of the wheelchair 12.

FIG. 2 also illustrates a second support member 62. The second support member 62 may be a small tubular metal ring slightly bigger than the upper mounting device 46. The second support member 62 is preferably held in place with a detent pin 66. The detent pin 66 enables the second support member 62 to be reversible. The second support member 62 is connected to a support pad 64 which is preferably identical on front and back and able to support a person's lower leg in the left or right position. Again, a clamp and screw mechanism may be used to secure the second support member 62 to the wheelchair 12. Another alternative embodiment of the second support member 62 allows the second support member 62 to be raised or lowered on the upper mounting device 46.

Figure 3:
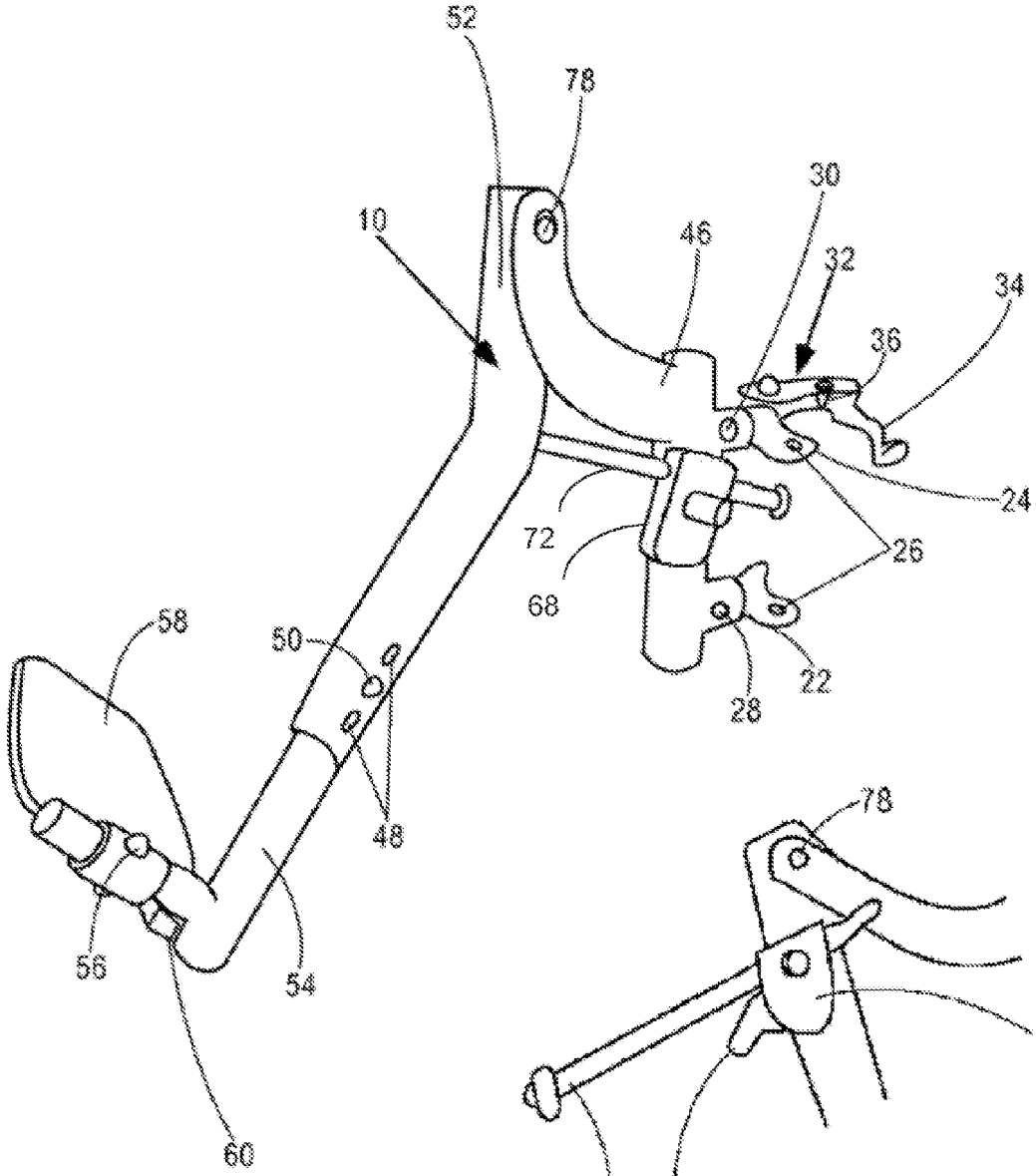
FIG. 3 illustrates an elevating reversible footrest that is capable of elevating and lowering depending on the needs of the user according to one embodiment of the invention.
Figure 3A:
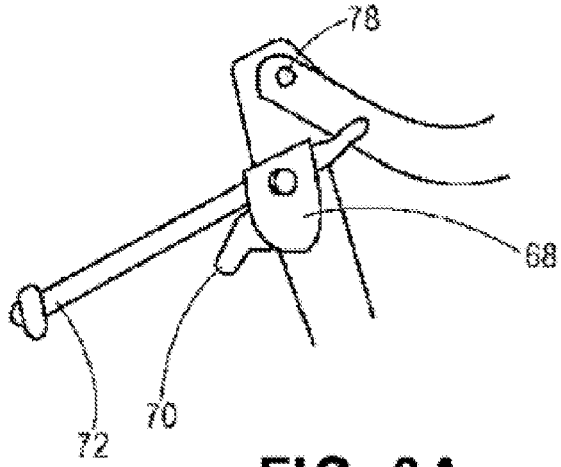
FIG. 3A illustrates a footrest elevation mechanism according to one embodiment of the invention.

FIG. 3 illustrates a footrest 10 according to one embodiment of the invention. The footrest 10 includes two attachment mechanisms 22, 24 protruding slightly from the upper mounting device 46 providing sufficient room to allow the attachment mechanisms 22, 24 to fit in the detent pins 28, 30. This embodiment allows the attachment mechanisms 22, 24 to be placed at the predetermined positions of 1⅜" or 3¼" depending on the type of wheelchair 12. The difference in body type allows placement of a pivoting member 68 to allow a second mounting device 52 to adjust in height depending on the needs of the user, as shown in FIG. 3A. A support rod 72 passes through the pivoting member 68 that is preferably welded to the upper mounting device 46. The support rod 72 is preferably welded to the second mounting device 52 at its end. A hinge joint 78 located at a junction between the upper mounting device 46 and the second mounting device 52 allows the pivoting action for the footrest 10 to be raised or lowered. A locking member 70 facilitates lowering of the footrest 10.

The pivoting member 68 is described in further detail below. In this embodiment, the plurality of holes 48 is located on the second mounting device 52 to adjust the length of the footrest 10. The footrest 10 may include a second support member 62 as shown in FIG. 2, connected to the second mounting device 52.

Figure 4:
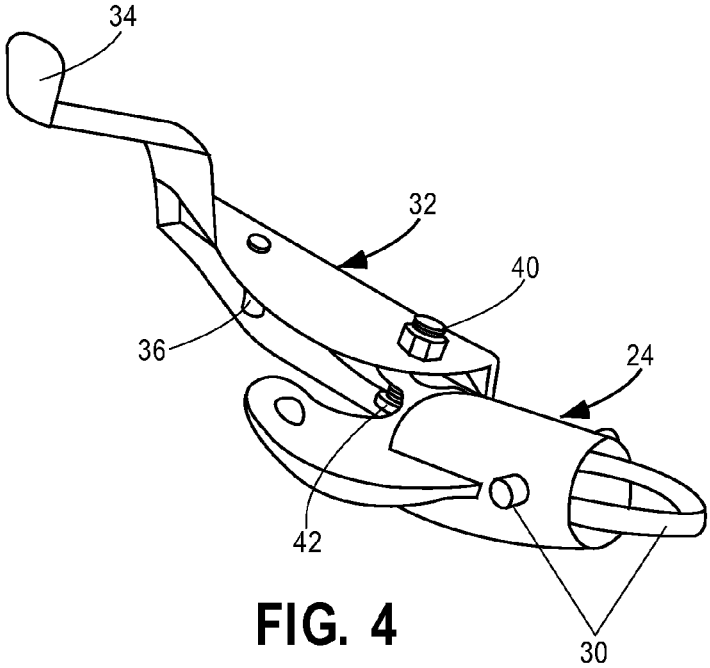
FIG. 4 illustrates a second attachment mechanism according to one embodiment of the invention.
Figure 5:
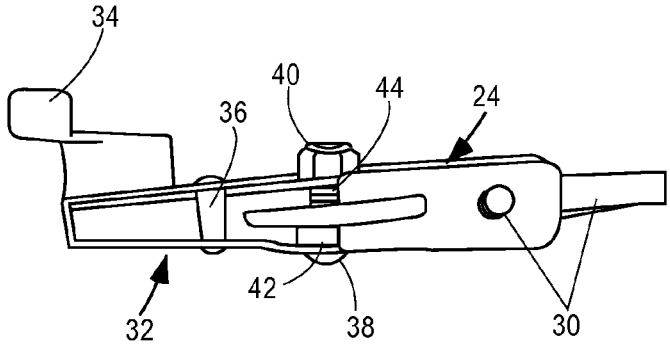
FIG. 5 is a side view of a second attachment mechanism according to one embodiment of the invention.
Figure 6:
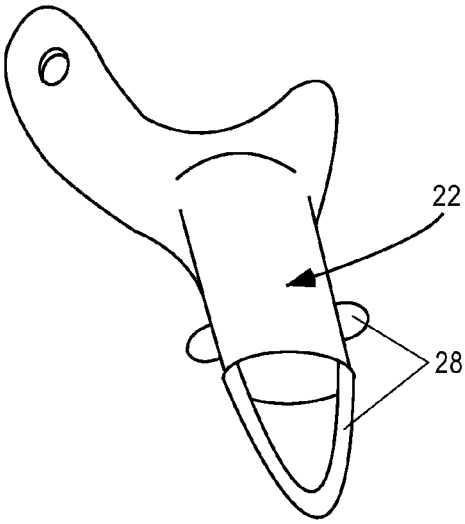
FIG. 6 illustrates a first attachment mechanism according to one embodiment of the invention.

FIG. 4 illustrates a centrally located connection portion of the second attachment mechanism 24, according to one embodiment of the invention. This enables the footrest 10 to be a mirror image of itself when rotated one-hundred-eighty (180) degrees. This enables the footrest 10 to be used on either side of the wheelchair 12. The latch mechanism 32 is connected to the second attachment mechanism 24 by a screw 38 and a bolt 40. A space, in this embodiment provided by a washer 42, is located between the second attachment mechanism 24 and the connection to the bolt 40 in the latch mechanism 32. The washer 42 provides space for the hinge plate 18 when in use on one side of the wheelchair 12 as shown in FIG. 5. A spring 44 allows the handle 34 to return to its resting position once released. The spring 44 also provides attachment space for the hinge plate 18 when being used on an opposite side of the wheelchair 12. FIG. 6 illustrates this embodiment of the first attachment mechanism 22. The connection portion of the first attachment mechanism 22 is also preferably centrally located. The first and second attachment mechanisms 22, 24 both may include the detent pins 28, 30.

Figure 7:
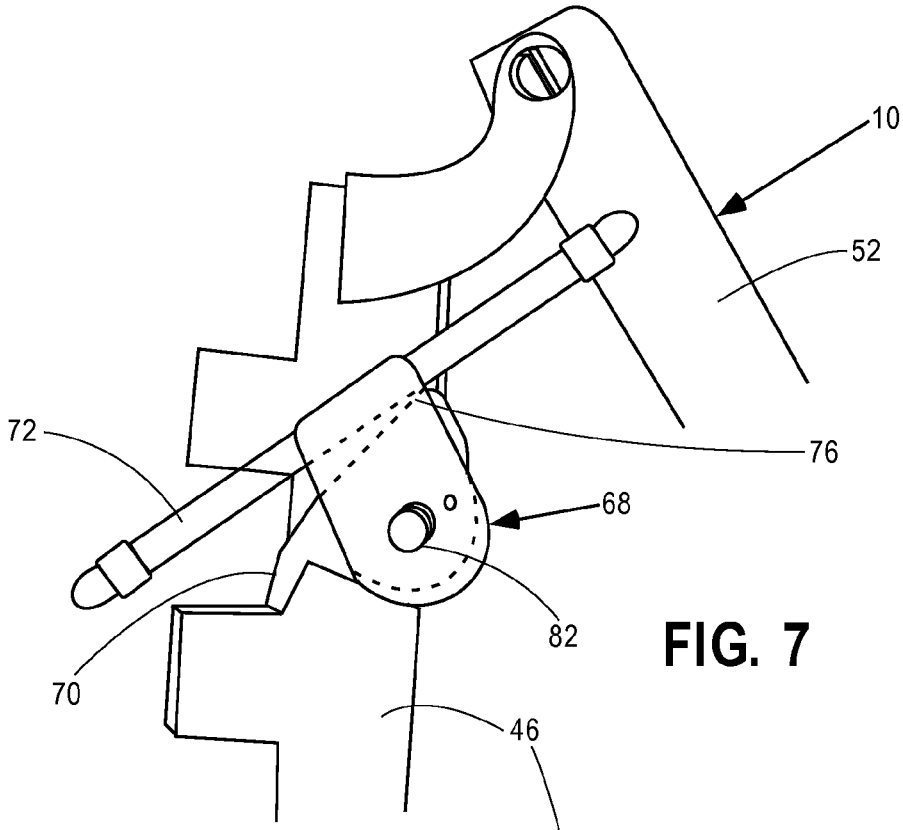
FIG. 7 illustrates a footrest elevation mechanism according to one embodiment of the invention.
Figure 8:
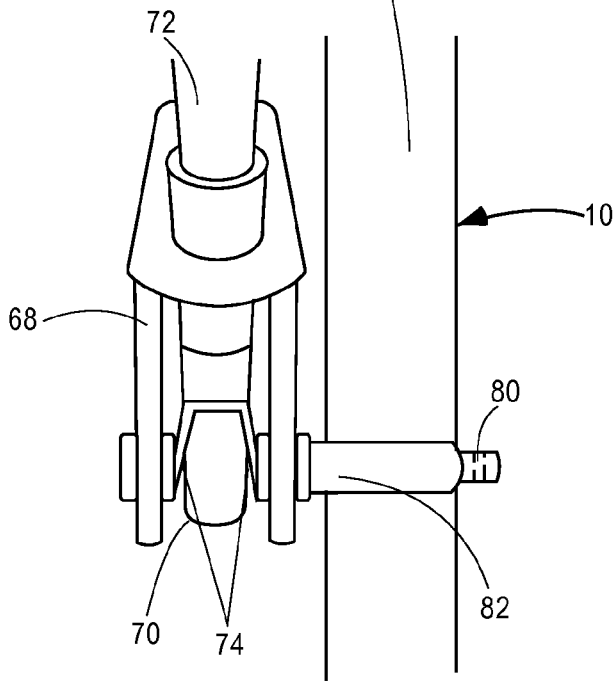
FIG. 8 illustrates a footrest elevation mechanism according to one embodiment of the invention.

Shown in FIG. 7, the support rod 72 connects the second mounting device 52 to the upper mounting device 46 thus facilitating raising and lowering of the footrest 10. The support rod 72 is placed at an upward angle, for example, forty (40) degrees, between the upper mounting device 46 and the second mounting device 52, with the support rod 72 passing through the pivoting member 68. The support rod 72, however, may be placed at any desired angle. The pivoting member 68 includes the locking member 70 with a spring 74 that allows the footrest 10 to be lowered when the locking member 70 is pressed in, or engaged, unlocking the footrest 10 from its current position as shown in FIG. 8. A pivoting member axle 82 connects the pivoting member 68 to the upper mounting device 46.

The locking member 70 may include locking grooves 76 located at the point where the locking member 70 and the support rod 72 meet. The locking grooves 76, when engaged, do not allow the footrest 10 to move in the downward direction without the locking member 70 being engaged. The orientation of the locking grooves 76 only impedes the footrest 10 from moving downward, but allows it to be raised without engaging the locking member 70. Pulling upward on any portion of the lower mounting device 54 raises the footrest 10. The locking member 70 is extended back from the pivoting member 68 to ease the user's ability to push in, or engage the locking member 70 and lower the footrest 10. By placing the second mounting device 52 at an angle on the support rod 72 the footrest 10 is elevated and extended during the elevation process. When the locking member 70 is released, the spring 74 also releases, pushing the top of the locking member 70 into the support rod 72. This locks the footrest 10 at the desired height.

FIG. 8 illustrates an alternative embodiment to the extension on the locking member 70 including an auxiliary lever space 80 located at the end of the pivoting member axle 82. A lever in the fashion used in the prior art can be inserted to lower the footrest 10 if desired. These and other options are available to allow the footrest 10 to be elevated and lowered to accommodate different patients.

Figure 9:
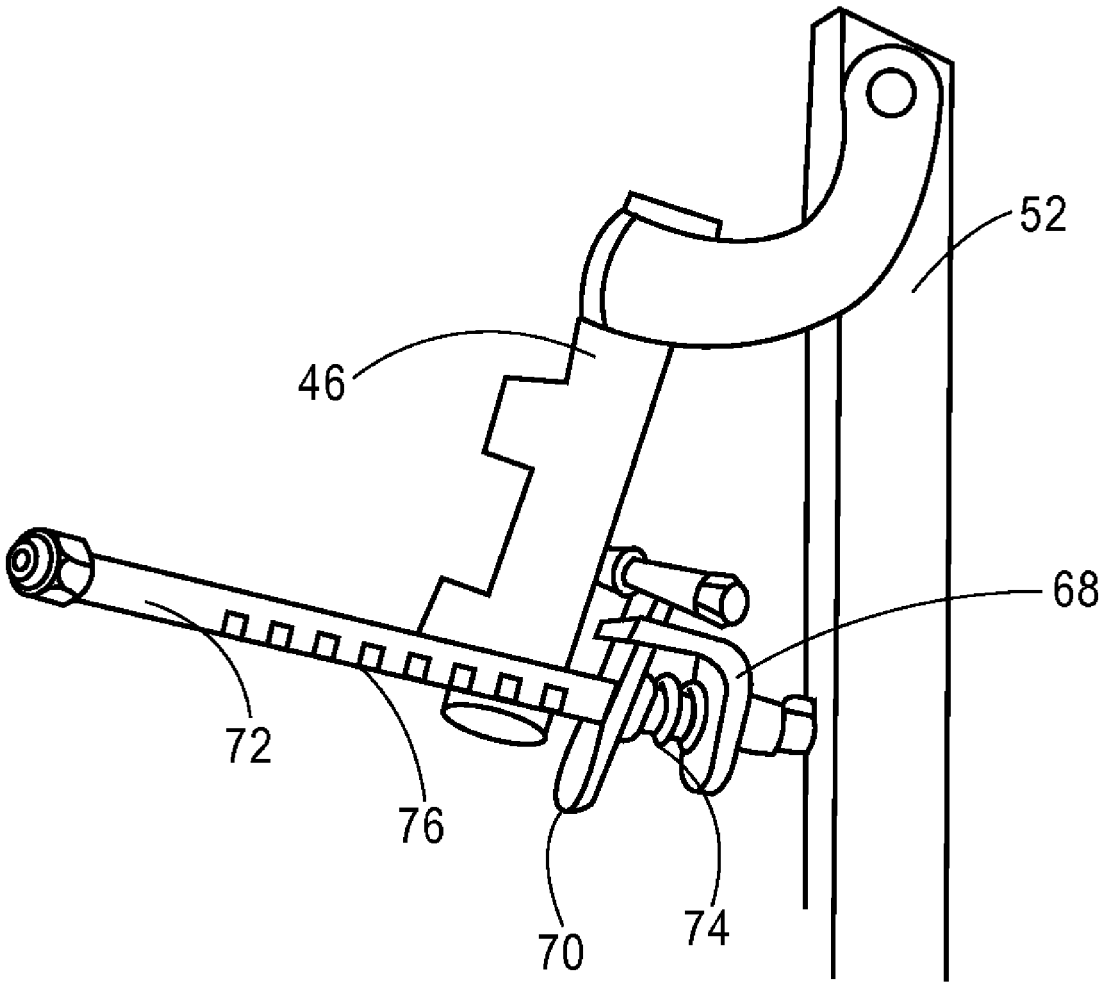
FIG. 9 illustrates a footrest elevation mechanism according to one embodiment of the invention.

FIG. 9 illustrates a footrest 10 according to one embodiment of the invention. The support rod 72 connects the second mounting device 52 to the upper mounting device 46 facilitating the raising and lowering of the footrest 10. The support rod 72 is placed at an upward angle, for example, forty (40) degrees, between the upper mounting device 46 and the second mounting device 52, with the support rod 72 passing through the pivoting member 68. The support rod 72, however, may be placed at any desired angle. The pivoting member 68 includes the locking member 70 with the spring 74 that allows the footrest 10 to be lowered when the locking member 70 is pressed in, or engaged. The support rod 72 may include locking grooves 76. The locking member 70 is extended down from the pivoting member 68 to ease the user's ability to push in, or engage the locking member 70 and lower the footrest 10. Raising the footrest 10 can be done without engaging the locking member 70 by pulling upward on any portion of the footrest 10.

The footrest 10 is adaptable to use on either the left or right side of a wheelchair 12. The first and second attachment mechanisms 22, 24 correspond to either the left or right side of the wheelchair pins 14 and preferably only lock-in place on the corresponding side.

The first attachment mechanism detent pin 28, shown in FIGS. 2 and 3, are released, enabling the attachment mechanism 22 to be turned 180 degrees. The detent pin 28 is then engaged to lock the attachment mechanism 22 in place. The second attachment mechanism 24 may then be reversed in the same manner. Once both sides are reversed, the footrest 10 is matched so that the pivot holes 26 are placed with the corresponding wheelchair pins 14 on the right or left side of wheelchair 12. Regardless of whether the footrest 10 is on the left or right side, the latch mechanism 32 may lock into place by sliding the attachment bar 36 over the notch 20 on the hinge plate 18, as illustrated in FIG. 1. The handle 34 releases the footrest 10.

Reversing of the first support member 58, shown in FIGS. 2 and 3, is performed by releasing the detent pin 56 and rotating the first support member 58 to the opposite side of footrest 10. Once the detent pin 56 is engaged, the first support member 58 is locked into place and ready for use. The stop mechanism 60 supports the first support member 58 on either side of the wheelchair 12. The stop mechanism 60 also serves to keep the first support member 58 in the horizontal plane and support the foot of the user.

Illustrated in FIG. 2, in order to reverse the second support member 62, the detent pin 66 is released and the second support member 62 is rotated by 180 degrees enabling use on the opposite side of the wheelchair 12. Engaging the detent pin 66 locks the second support member 62 in place.

The length adjustment mechanism detent pin 50, shown in FIGS. 2 and 3, is released, thus allowing the raising or lowering of the lower mounting device 54 to best accommodate the user. By engaging the detent pin 50 in the appropriate hole on the upper mounting device 46 or the second mounting device 52, the lower mounting device 54 is locked into place.

Lowering of the second mounting device 52 is initiated through the pivoting member 68 as shown in FIG. 7. The footrest 10 may be raised without engaging the locking member 70 by pulling up in the vertical direction on a component of the footrest 10, such as the lower mounting device 54. The locking member 70 is pressed in which unlocks the footrest 10 on the support rod 72 to allow the second mounting device 52 to be lowered to best accommodate the user. Once the locking member 70 is released, an internal spring 74 pushes the locking grooves 76 into the support rod 72 locking the second mounting device 52 in the desired position to prevent it from being lowered once the footrest 10 is being used illustrated in FIG. 8.

The invention is not to be limited in scope by the specific embodiments described herein. Indeed, various modifications of the present invention, in addition to those described herein, will be apparent to those of ordinary skill in the art from the foregoing description and accompanying drawings. Thus, such modifications are intended to fall within the scope of the following appended claims. Further, although the present invention has been described herein in the context of a particular implementation in a particular environment for a particular purpose, those of ordinary skill in the art will recognize that its usefulness is not limited thereto and that the present invention can be beneficially implemented in any number of environments for any number of purposes. Accordingly, the claims set forth below should be construed in view of the full breath and spirit of the present invention as disclosed herein.

What is claimed is:

1. A reversible footrest for a wheelchair comprising:

an upper mounting device configured to attach to a wheelchair;

a first attachment mechanism configured to secure the upper mounting device to the wheelchair, wherein the first attachment mechanism is rotatably secured to the upper mounting device by way of a detent pin and secured to the wheelchair by way of a pivot hole, wherein the detent pin is configured to enable the first attachment mechanism to rotate by about 180 degrees about a longitudinal axis of the upper mounting device, thereby rotating the pivot hole by about 180 degrees for attaching the first attachment mechanism to an opposite side of the wheelchair, enabling the upper mounting device to be attached to either side of the wheelchair;

a lower mounting device secured to the upper mounting device; and, a first support member configured to support a foot of a person riding in the wheelchair, wherein the first support member is configured to rotate about a second axis of the lower mounting device.

2. The footrest of claim 1, further comprising a second support member configured to support a lower leg portion of the person.

3. The footrest of claim 1, further comprising a second attachment mechanism configured to connect to an attachment pin of the wheelchair.

4. The footrest of claim 3, wherein the second attachment mechanism comprises a detent pin configured to enable the second attachment mechanism to rotate about a third axis of the upper mounting device enabling the upper mounting device to be attached to either side of the wheelchair.

5. The footrest of claim 3, wherein the second attachment mechanism comprises a releasable member configured to enable the second attachment mechanism to rotate about the third axis of the upper mounting device.

6. The footrest of claim 1, further comprising a length adjusting mechanism configured to enable adjustment of a length of the footrest.

7. The footrest of claim 6, wherein the length adjusting mechanism comprises a detent pin.

8. The footrest of claim 1, further comprising a stop mechanism configured to prevent the first support member from rotating beyond a predetermined point on the lower mounting device.

9. The footrest of claim 1, wherein the first support member comprises a first side and a second side, wherein the first side and the second side are mirror images of each other.

10. The footrest of claim 1, wherein the first support member comprises a releasable member configured to enable the first support member to rotate about the second axis of the lower mounting device.

11. The footrest of claim 1, wherein the second attachment mechanism comprises a latch configured to lock and unlock a latch mechanism.

12. The footrest of claim 1, further comprising a second support member rotatably secured to the upper mounting device enabling the second support member to be used on either side of the wheelchair.

13. The footrest of claim 12, wherein the second support member comprises a releasable member configured to enable the second support member to rotate about a fourth axis of the upper mounting device.

14. A reversible footrest for a wheelchair comprising:

an upper mounting device; wherein the upper mounting device comprises a first attaching mechanism configured to secure the upper mounting device to the wheelchair, and wherein the first attaching mechanism is configured to rotate about the upper mounting device enabling the upper mounting device to be attached to either side of the wheelchair;

a second mounting device secured to the upper mounting device;

a pivoting member configured to pivot the second mounting device about the upper mounting device;

a rod attached to the second mounting device and extending into the pivoting member; and, a lower mounting device secured to the second mounting device wherein the lower mounting device comprises a first support member configured to support a foot of a person riding in the wheelchair, and wherein the first support member is configured to rotate about the lower mounting device enabling the first support member to be used on either side of the wheelchair.

15. The footrest of claim 14, further comprising a second support member rotatably secured to the second mounting device enabling the second support member to be used on either side of the wheelchair.

16. The footrest of claim 14, wherein the second support member comprises a releasable member configured to enable the second support member to rotate about a first axis of the second mounting device.

17. The footrest of claim 14, wherein the lower mounting device comprises a length adjusting mechanism configured to adjust the length of the lower mounting device.

18. The footrest of claim 14, further compromising a second attaching mechanism configured to secure the upper mounting device to the wheelchair.

19. The footrest of claim 14, wherein the second attachment mechanism comprises a latch configured to lock and unlock a latch mechanism.

20. The footrest of claim 19, wherein the second attaching mechanism comprises a releasable member configured to enable the second attaching mechanism to rotate about a second axis of the upper mounting device.

21. The footrest of claim 14, wherein the first support member comprises a releasable attaching device.

22. The footrest of claim 14, wherein the first support member comprises a first side and a second side, wherein the first side and the second side are mirror images of each other.

23. The footrest of claim 14, wherein the first attaching mechanism comprises a detent pin.

24. The footrest of claim 14, further comprising a stop mechanism configured to prevent the first support member from rotating beyond a predetermined point on the lower mounting device.

25. The footrest of claim 14, wherein the first attachment mechanism comprises a releasable member configured to enable the first attachment mechanism to rotate about a third axis of the upper mounting device.

* * * * *